US011580902B2

(12) United States Patent
Xia et al.

(10) Patent No.: US 11,580,902 B2
(45) Date of Patent: Feb. 14, 2023

(54) DRIVING METHOD AND APPARATUS OF A DISPLAY PANEL

(71) Applicant: Everdisplay Optronics (Shanghai) Co., Ltd., Shanghai (CN)

(72) Inventors: Zhouhui Xia, Shanghai (CN); Xiangyu Jiang, Shanghai (CN); JehYen Kang, Shanghai (CN); Keitaro Yamashita, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/571,634

(22) Filed: Jan. 10, 2022

(65) Prior Publication Data

US 2022/0223105 A1 Jul. 14, 2022

(30) Foreign Application Priority Data

Jan. 11, 2021 (CN) ..... 202110033926.0

(51) Int. Cl.
*G09G 3/3208* (2016.01)

(52) U.S. Cl.
CPC ... *G09G 3/3208* (2013.01); *G09G 2320/0247* (2013.01); *G09G 2320/103* (2013.01); *G09G 2330/021* (2013.01); *G09G 2340/0435* (2013.01)

(58) Field of Classification Search
CPC ..... G09G 2320/103; G09G 2320/0247; G09G 2340/0435
See application file for complete search history.

(56) References Cited

U.S. PATENT DOCUMENTS

| | | | | |
|---|---|---|---|---|
| 9,501,993 | B2 * | 11/2016 | Nambi | G09G 3/36 |
| 10,056,050 | B2 * | 8/2018 | Nambi | G09G 3/36 |
| 10,586,496 | B2 * | 3/2020 | Kim | G09G 3/3275 |
| 10,748,496 | B2 * | 8/2020 | Huang | G09G 3/3614 |
| 11,289,029 | B1 * | 3/2022 | Sung | G09G 3/3291 |
| 11,322,077 | B1 * | 5/2022 | Chun | G09G 3/3208 |
| 11,380,255 | B2 * | 7/2022 | Zhang | G09G 3/006 |
| 2014/0198093 | A1 * | 7/2014 | Nambi | G09G 3/3611 345/212 |
| 2014/0198114 | A1 * | 7/2014 | Nambi | G09G 3/3618 345/522 |
| 2017/0004772 | A1 * | 1/2017 | Han | G09G 3/325 |
| 2017/0206837 | A1 * | 7/2017 | Jeon | G09G 3/3275 |
| 2018/0059868 | A1 * | 3/2018 | Brahma | G09G 3/2022 |

(Continued)

*Primary Examiner* — Patrick F Marinelli
(74) *Attorney, Agent, or Firm* — Qinghong Xu

(57) ABSTRACT

The present disclosure relates to the technical field of display panels, in particular to a driving method and driving apparatus of a display panel. The driving method may include in response to detecting that the display panel is switched from a dynamic picture to a static picture, generating a refresh rate adjustment instruction; according to the refresh rate adjustment instruction, switching the picture refresh rate of the display panel from a first picture refresh rate to a second picture refresh rate and generating a voltage adjustment instruction; obtaining a target cathode power supply voltage matching the second picture refresh rate; and based on the voltage adjustment instruction and the target cathode power supply voltage, adjusting the display panel to change a working current of each pixel in the display panel.

8 Claims, 3 Drawing Sheets

(56) References Cited

U.S. PATENT DOCUMENTS

| | | | | |
|---|---|---|---|---|
| 2018/0293944 | A1* | 10/2018 | Kim | G09G 3/3233 |
| 2019/0189071 | A1* | 6/2019 | Huang | G09G 3/3614 |
| 2019/0244576 | A1* | 8/2019 | Kwak | G09G 3/3655 |
| 2021/0358406 | A1* | 11/2021 | Zhang | G09G 3/3233 |
| 2022/0044628 | A1* | 2/2022 | Li | G09G 3/3233 |
| 2022/0051599 | A1* | 2/2022 | Kang | G09G 3/2007 |
| 2022/0051630 | A1* | 2/2022 | Shen | G09G 3/3275 |
| 2022/0114959 | A1* | 4/2022 | Chung | G09G 3/3258 |

* cited by examiner

DRIVING METHOD AND APPARATUS OF A DISPLAY PANEL

CROSS REFERENCE

This application is based upon and claims priority to Chinese Patent Application No. 202110033926.0, field on Jan. 11, 2021, the entire contents of which are incorporated herein by reference.

TECHNICAL FIELD

The present disclosure relates to the technical field of display panels, in particular to a driving method and driving apparatus of a display panel.

BACKGROUND

Seamless Dynamic Refresh Rate Switching (SDRRS) technology is a power-saving technology for notebook computers proposed by Intel Corporation. Based on SDRRS, when a display panel of the notebook computer is in a state of displaying a static picture, its picture refresh rate can be switched from 60 Hz to 40 Hz, in order to achieve the purpose of effectively reducing the power consumption of the display, i.e., saving power.

However, when the display panel is switched to a different refresh rate, the charging time and discharging time of the display panel will be different, and therefore the brightness of the picture in the screen will be different, and human eyes will feel flicker. Specifically, for example, when the picture refresh rate of the display panel is 60 Hz, the charging time is shorter, so the brightness is lower. In the case of a picture refresh rate of 40 Hz, the charging time is longer, so the brightness is higher. Therefore, when the SDRRS technology is turned on and turned off, the brightness difference would be generated due to the switching of the picture refresh rate. For the human eye, the human eye is not sensitive to brightness changes at high brightness (i.e., at a high gray scale state), but at a low gray scale state, that is, when the brightness is low, the human eye is more sensitive to brightness changes. The greater the brightness change amplitude is, the easier it is for the human eye to catch, so human eyes will feel flicker.

SUMMARY

According to one aspect of the present disclosure, a driving method of a display panel is provided. The driving method may include in response to detecting that the display panel is switched from a dynamic picture to a static picture, generating a refresh rate adjustment instruction; according to the refresh rate adjustment instruction, switching the picture refresh rate of the display panel from a first picture refresh rate to a second picture refresh rate and generating a voltage adjustment instruction; obtaining a target cathode power supply voltage matching the second picture refresh rate; and based on the voltage adjustment instruction and the target cathode power supply voltage, adjusting the display panel to change a working current of each pixel in the display panel.

According to a second aspect of the embodiments of the present disclosure, there is provided a driving apparatus of a display panel used to implement the driving method of the display panel above. The driving apparatus of the display panel may include a picture detection unit configured to generate a refresh rate adjustment instruction in response to detecting that the display panel is switched from a dynamic picture to a static picture and send the refresh rate adjustment instruction to the timing controller; a timing controller configured to, according to the refresh rate adjustment instruction, switch the picture refresh rate of the display panel from a first picture refresh rate to a second picture refresh rate and generate a voltage adjustment instruction, and send voltage adjustment instruction to the power supply driving chip; a target cathode voltage determination unit configured to obtain a target cathode power supply voltage matching the second picture refresh rate; and a power supply driving chip configured to adjust the display panel to change a working current of each pixel in the display panel, based on the voltage adjustment instruction and the target cathode power supply voltage.

According to a third aspect of the embodiments of the present disclosure, there is provided a driving method of a display panel. The driving method may include in response to detecting that the display panel is switched from a static picture to a dynamic picture, generating a refresh rate adjustment instruction; according to the refresh rate adjustment instruction, switching the picture refresh rate of the display panel from a third picture refresh rate to a fourth picture refresh rate and generating a voltage adjustment instruction; obtaining a target cathode power supply voltage matching the fourth picture refresh rate; and based on the voltage adjustment instruction and the target cathode power supply voltage, adjusting the display panel to change a working current of each pixel in the display panel.

BRIEF DESCRIPTION OF THE DRAWINGS

The drawings here are incorporated into the specification and constitute a part of the specification, show embodiments in accordance with the present disclosure and are used to explain the principle of the present disclosure together with the specification. Obviously, the drawings in the following description are only some embodiments of the present disclosure. For those of ordinary skill in the art, other drawings can be obtained based on these drawings without creative work.

DETAILED DESCRIPTION

Figure 1:
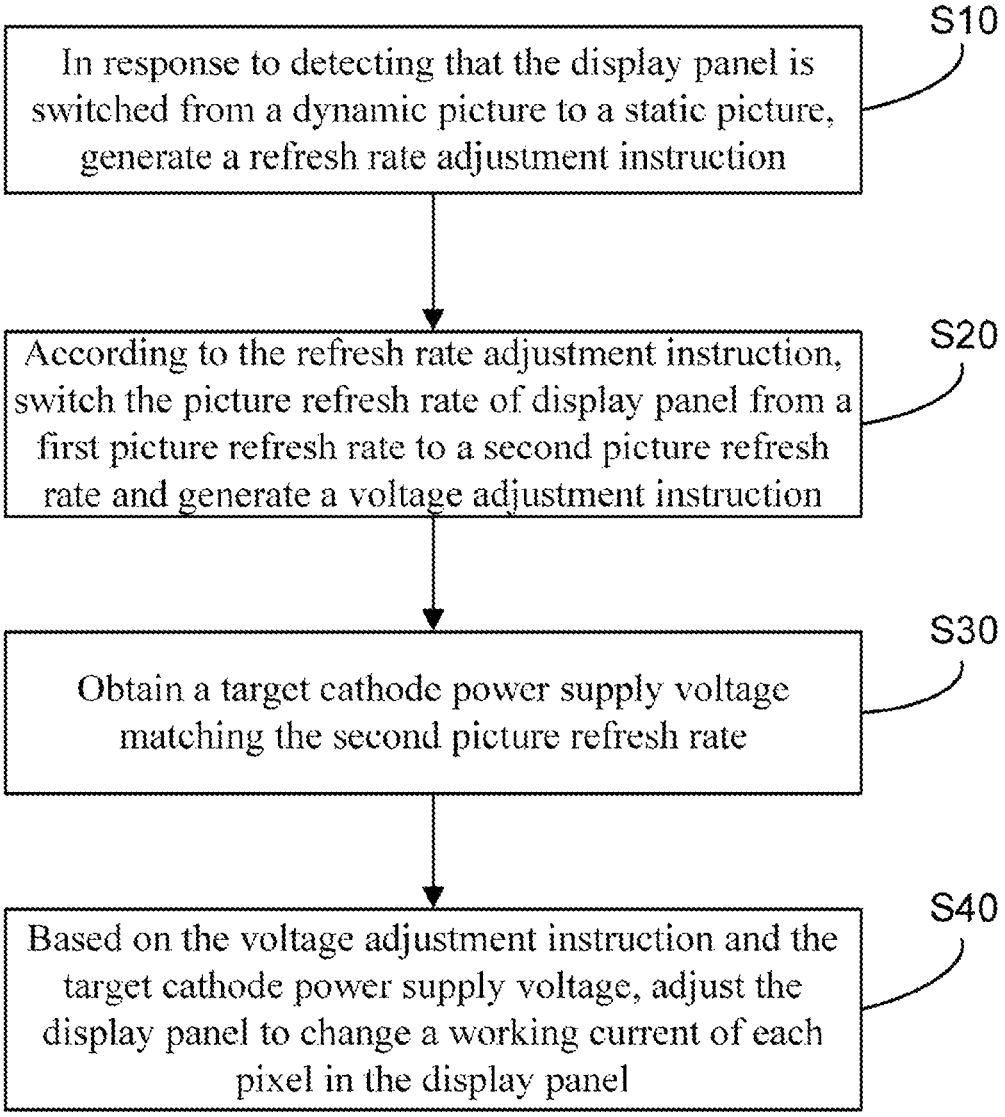
FIG. 1 is a schematic diagram of a driving method of a display panel according to some embodiments of the present disclosure.

Example embodiments will now be described more fully with reference to the accompanying drawings. However, the embodiments can be implemented in various forms, and should not be construed as being limited to the embodiments set forth herein. On the contrary, these embodiments are provided so that the present disclosure will be comprehensive and complete, and will fully convey the concept of embodiments to those skilled in the art. The same reference numerals in the figures indicate the same or similar structures, and thus their repeated description will be omitted.

When a display panel is switched to a different refresh rate, the charging time and discharging time of the display panel will be different, and therefore the brightness of the picture in the screen will be different, and human eyes will feel flicker. Specifically, for example, when the picture refresh rate of the display panel is 60 Hz, the charging time is shorter, so the brightness is lower. In the case of a picture refresh rate of 40 Hz, the charging time is longer, so the brightness is higher. Therefore, when the SDRRS technology is turned on and turned off, the brightness difference would be generated due to the switching of the picture refresh rate. For the human eye, the human eye is not sensitive to brightness changes at high brightness (i.e., at a high gray scale state), but at a low gray scale state, that is, when the brightness is low, the human eye is more sensitive to brightness changes. The greater the brightness change amplitude is, the easier it is for the human eye to catch, so human eyes will feel flicker.

The Organic Light-Emitting Diode (OLED) panel is lighted up under the control of a cathode power supply voltage ELVSS, an anode power supply voltage ELVDD, a pixel driving voltage and a data signal, and the lighting-up brightness of the OLED panel is determined by the working current of the OLED pixel.

In view of this, the present disclosure provides a driving method and a driving apparatus of a display panel to solve the problem of screen or picture flicker due to excessive brightness difference of the display panel when the notebook computer adopting an organic light emitting diode (OLED) display panel switches the picture refresh rate.

As shown in FIG. 1, the present disclosure discloses a driving method of a display panel, which is used to solve the following problem, in case that the Seamless Dynamic Refresh Rate Switching (SDRRS) technology is turned on in a notebook computer using an OLED display panel, when the display panel is switched from a dynamic picture to a static picture or switched from a static picture to a dynamic picture, the brightness difference generated by the display panel is too large, which causes the problem of obvious screen or picture flicker.

The driving method of the display panel disclosed in some embodiments of the present includes the following steps.

At a step S10, when it is detected that the display panel is switched from the dynamic image to the static image, a refresh rate adjustment instruction is generated. Specifically, in this embodiment, it is determined whether the seamless dynamic refresh rate switching (SDRRS) technology is switched from an off state to a on state, and if it is switched from the off state to the on state, it is determined that the display panel is switched from the dynamic picture to the static picture, and the refresh rate adjustment instruction is sent to a timing controller (TCON) of the display panel. If the switching state of the SDRRS technology does not change, the current picture refresh rate will remain unchanged.

After determining that the display panel is switched from the dynamic picture to the static picture, the refresh rate adjustment instruction is sent to the timing controller (TCON) of the display panel, that is, the timing controller is notified to reduce the picture refresh rate, so as to reduce power consumption and achieve the purpose of energy saving.

At a step S20, the picture refresh rate of the display panel is switched from a first picture refresh rate to a second picture refresh rate according to the refresh rate adjustment instruction, and a voltage adjustment instruction is generated based on the refresh rate adjustment instruction and is sent to the power supply driving chip. In this embodiment, the first picture refresh rate is greater than the second picture refresh rate, that is, the picture refresh rate is reduced, and the power consumption is reduced. For example, the first picture refresh rate is 60 Hz, and the second picture refresh rate is 40 Hz. At this time, the brightness of the display panel will increase. If the brightness difference is too large, the human eyes will experience obvious picture flicker, which is not conducive to the user experience, so it is needed to reduce the brightness difference before and after the brightness rises is reduced (i.e., reducing the amplitude of brightness change), and the occurrence of the screen flicker phenomenon is avoided.

Moreover, in this embodiment, a target cathode power supply voltage matching the second picture refresh rate is greater than a cathode power supply voltage matching the first picture refresh rate.

At a step S30, the target cathode power supply voltage matching the second picture refresh rate is obtained and is sent to the power supply driving chip. In some embodiments, the target cathode power supply voltage is obtained based on a mapping database.

At a step S40, the display panel is adjusted according to the voltage adjustment instruction and the target cathode power supply voltage, so as to change a working current of each pixel in the display panel. Specifically, when the picture refresh rate of the display panel decreases, that is, when the first picture refresh rate is greater than the second picture refresh rate, the cathode power supply voltage of the display panel is increased to the target cathode power supply voltage, in order to reduce the working current of each pixel in the display panel, thus achieving the purpose of adjusting the brightness of the display panel and reducing the brightness difference before and after switching the picture refresh rate.

The method further includes a step, in which a mapping database regarding a mapping relationship between the cathode power supply voltage and the picture refresh rate of the display panel is preset. In the above mapping database, one cathode power supply voltage value corresponds to one picture refresh rate. The cathode power supply voltage increases with the decrease of the picture refresh rate, and decreases with the increase of the picture refresh rate. That is, there is a negative correlation between the cathode power supply voltage and the above-mentioned picture refresh rate.

Table 1 below shows an example of the mapping database.

TABLE 1

| | 120 Hz | 90 Hz | 60 Hz | 40 Hz | 10 Hz |
|---|---|---|---|---|---|
| ELVSS (V) | −X1 | −X2 | −X3 | −X4 | −X5 |
| Corresponding Instruction | 0x01 | 0x02 | 0x03 | 0x04 | 0x05 |

The corresponding instructions in Table 1 are for illustration only, and X1>X2>X3>X4>X5>the absolute value of saturation voltage.

In the prior art, in case that the OLED display panel of a device such as a notebook computer or a tablet computer is working, when the picture refresh rate changes, the value of the cathode power supply voltage is unchanged. For example, when the picture refresh rate switched from 60 Hz to 40 Hz, the cathode power supply voltage is constant or unchanged. Furthermore, in the case of 60 Hz, the charging time is shorter and the brightness is lower; while in the case of 40 Hz, the charging time is longer and the brightness is higher. During the switching process, the brightness difference is too large, and the human eyes feel the flicker phenomenon. The present disclosure is capable to reduce the working current of the pixel, by increasing the value of the cathode power supply voltage, when the picture refresh rate is reduced, that is, the value of the cathode power supply voltage can be changed, so that, compared to the brightness value corresponding to the 40 Hz refresh rate in the prior art, the brightness value according to the present disclosure is reduced, that is, the amplitude of increased brightness is reduced after the picture refresh rate is reduced, so that the picture flicker is avoided.

In the present disclosure, a display panel is tested at a low gray scale state (0-128 gray scale). The comparison of the brightness change amplitude before and after applying the present disclosure is shown in Table 2 below:

TABLE 2

| | brightness | | | brightness change amplitude | |
|---|---|---|---|---|---|
| gray scale | 60 Hz | 40 Hz(with constant ELVSS voltage | 40 Hz(with adjusted ELVSS voltage) | constant ELVSS voltage | with adjusted ELVSS voltage |
| 0 | 0.00 | 0.00 | 0.00 | 0.00% | 0.00% |
| 16 | 2.44 | 2.79 | 2.25 | 14.34% | 7.78% |
| 32 | 8.56 | 9.27 | 8.39 | 8.29% | 1.98% |
| 64 | 29.35 | 30.78 | 29.29 | 4.87% | 0.20% |
| 96 | 61.26 | 62.46 | 60.98 | 1.96% | 0.46% |
| 128 | 105.23 | 106.58 | 104.33 | 1.28% | 0.85% |

It should be noted that the gray scale of the display panel is determined according to the display panel. Taking an 8-bit display panel as an example, the display panel can show gray scales of $2^8$ (i.e., the 8th power of 2), which is equal to 256 brightness levels, so it is called 0-255 gray scales. For a display panel with 0-255 gray scales, when the gray scale is lower than the 64 gray scale, it can be defined that it is in a low gray scale state. For a display panel with 0-1023 gray scales, when the gray scale is lower than the 256 gray scale, it can be defined that it is in a low gray scale state.

When a display panel is in a low gray scale state, no matter whether the display panel is switched from the high brightness to the low brightness, or from the low brightness to the high brightness, there will be obvious brightness change, and the human eye can sensitively capture this difference. However, the improvement effect of the present disclosure on the low gray scale state is particularly obvious, so that the occurrence of flicker when switching the refresh rate can be avoided and the human eye will not feel the flicker.

Refer to Table 2, the amplitude of the brightness change is $$\Delta Lv = \frac{|Lv_{60Hz} - Lv_{40Hz}|}{Lv_{60Hz}} * 100\%.$$

For example, for the gray scale of 32, in the prior art, when the picture refresh rate is 60 Hz, the display brightness is 8.56 nit, and when the picture refresh rate is adjusted to 40 Hz, the display brightness is 9.27 nit, and the amplitude of the brightness change is $$\Delta Lv = \frac{|8.56 - 9.27|}{8.56} * 100\%,$$

that is ΔLv=8.29%. After applying the driving method provided by the present disclosure, when the picture refresh rate is adjusted to 40 Hz, the display brightness is 8.39 nit, and the amplitude of the brightness variation $$\Delta Lv = \frac{|8.56 - 8.39|}{8.56} * 100\%,$$

that is, ΔLv is reduced to 1.98% at this time. Therefore, it can be seen that after adopting the technical solution provided by the present disclosure, the amplitude of the brightness change is significantly reduced, thereby avoiding the occurrence of flicker when switching the refresh rate.

It can be seen from Table 2 that after applying the present disclosure, the amplitude of the brightness change at different picture refresh rates has been significantly improved. In addition, the improvement effect of the brightness difference in the low gray scale of the present disclosure is particularly obvious. Since the human eye is more sensitive to the brightness change of the low gray scale, the present disclosure has a good user experience.

Figure 2:
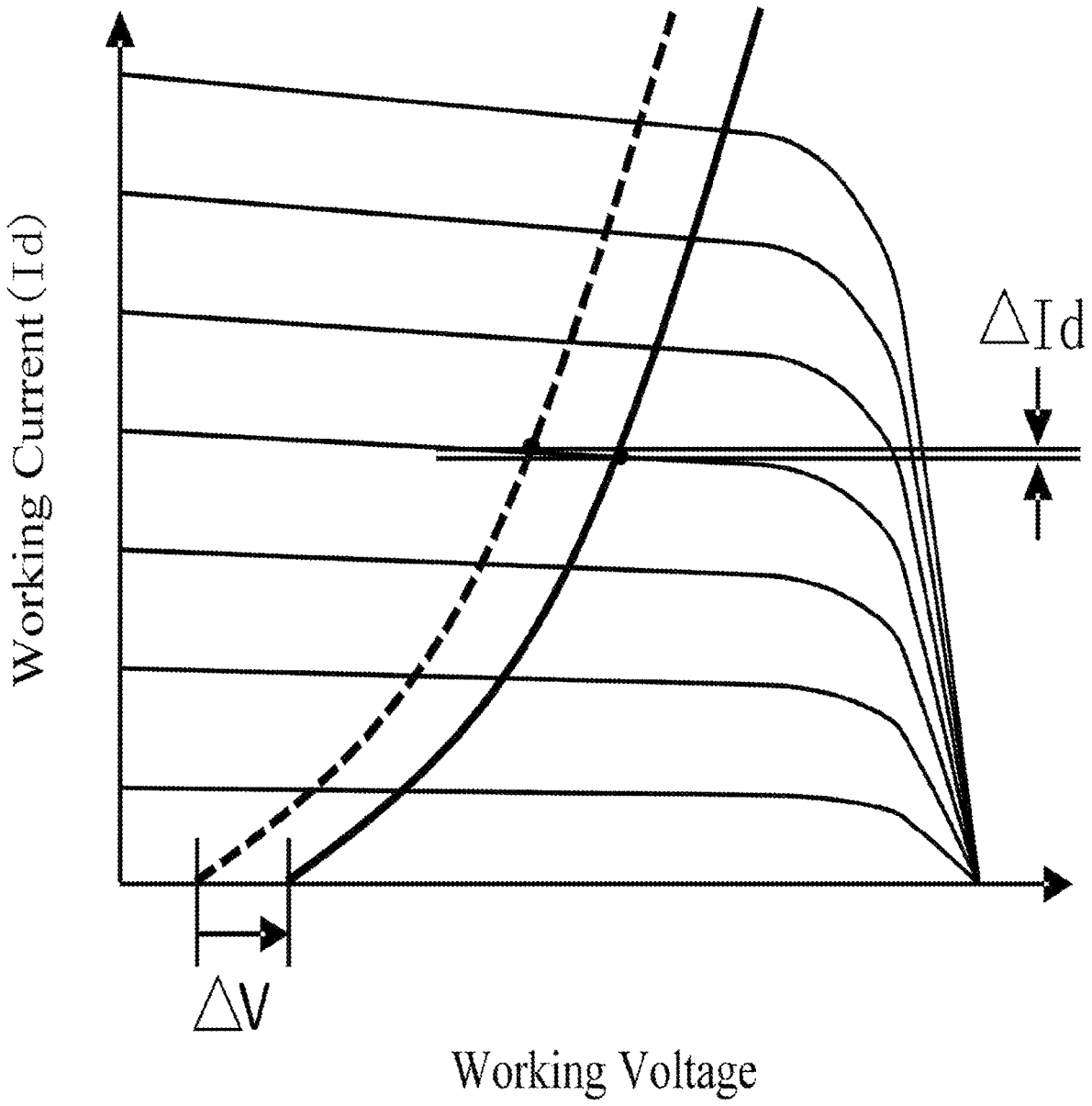
FIG. 2 is a schematic diagram showing a comparison of current-voltage characteristic curves of the OLED panel when operated in the prior art and operated according to the present disclosure.

FIG. 2 is a schematic diagram showing a comparison of current-voltage characteristic curves of the OLED panel when operated in the prior art and operated according to the present disclosure. The dotted line in FIG. 2 represents the current-voltage characteristic curve of the OLED panel during operation in the prior art. The solid line in FIG. 2 represents the current-voltage characteristic curve of the OLED panel during operation according to the present disclosure. When the OLED panel is operated normally, the current-voltage characteristic curve appears close to a horizontal line, that is, the working current changes very little. After applying the driving method of the present disclosure, when it is detected that the display panel is switched from the dynamic image to the static image, that is, when the SDRRS technology is turned on, the ELVSS voltage of the display panel is increased, as compared with the prior art, the present disclosure increases the ELVSS voltage of the display panel and then the working current of the pixel is decreased, wherein ΔV represents the adjusted amplitude of ELVSS voltage, and ΔId represents the changed amplitude of the working current of the pixel. According to the present disclosure, ELVSS has a negative value, ELVDD has a positive value, and as ELVSS gets closer to the positive value, the current gets smaller and the brightness gets lower. It can be seen from FIG. 2 that after adjusting the ELVSS voltage, the working current of the pixel is reduced, so that the brightness of the display panel is reduced, and the purpose of reducing the brightness difference generated when the picture refresh rate is switched is achieved.

It should be noted that the driving method of a display panel provided in the present disclosure can also be applied to the case where the display panel is switched from a static picture to a dynamic picture. Among them, if the SDRRS technology is switched from the on state to the off state, then it is determined that the display panel is switched from a static picture to a dynamic picture.

In this case, a refresh rate adjustment instruction is also sent to the timing controller (TCON) of the display panel, and the timing controller switches the picture refresh rate of the display panel from a third picture refresh rate to a fourth picture refresh rate according to the refresh rate adjustment instruction, and generates and sends a voltage adjustment instruction to the power supply driving chip. Then, according to the above-mentioned mapping database, a second target cathode power supply voltage matching the fourth frame refresh rate is obtained and sent to the power supply driving chip. Then, according to the voltage adjustment instruction and the second target cathode power supply voltage, the above-mentioned display panel is adjusted to increase the working current of each pixel in the display panel. Wherein, the third picture refresh rate is less than the fourth picture refresh rate.

Accordingly, at this time, it is necessary to reduce the cathode power supply voltage ELVSS to increase the working current of each pixel, so as to achieve the purpose of improving the brightness of the display panel, thus in case that the picture refresh rate of the display panel increases, the brightness difference before and after the brightness reduces is decreased and the occurrence of flicker is avoided. The above technical solutions are also within the protection scope of the present disclosure.

Figure 3:
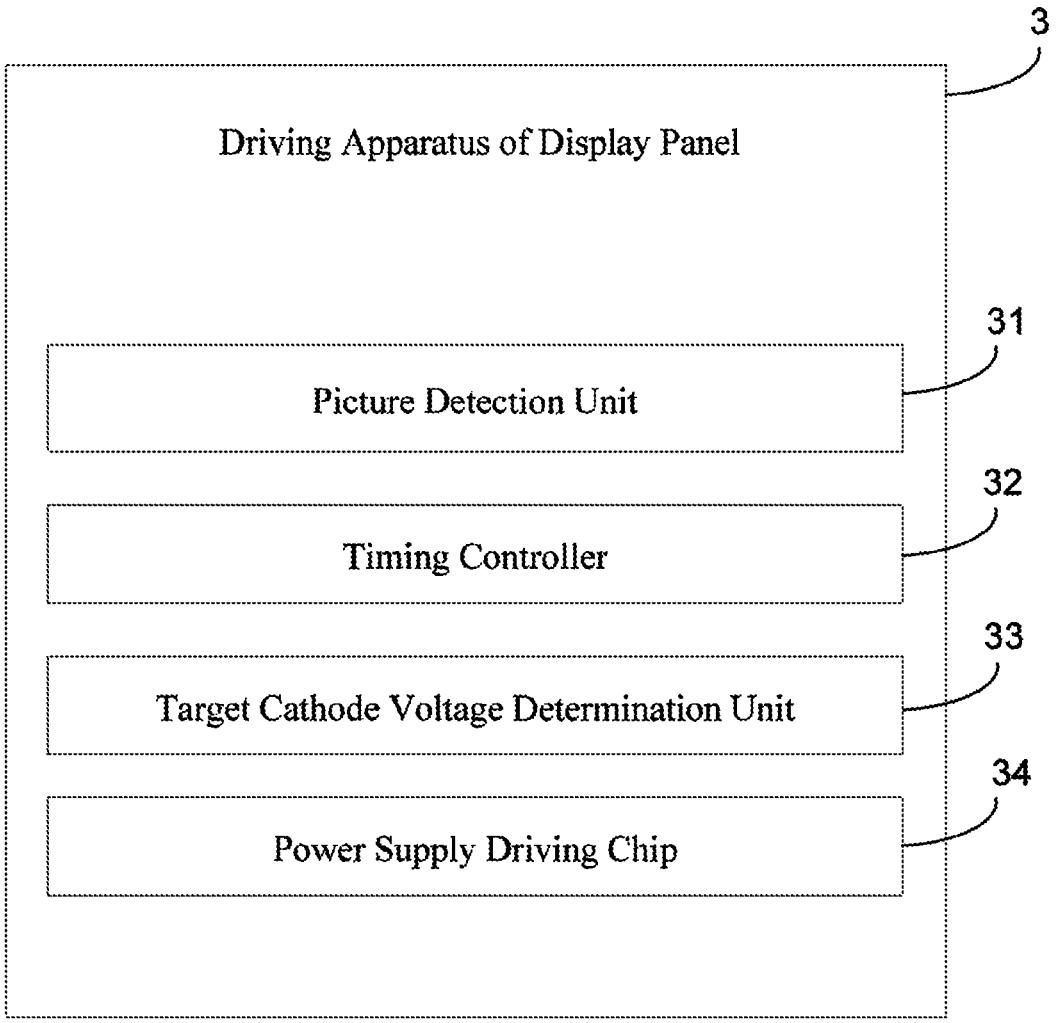
FIG. 3 is a schematic structural diagram of a driving apparatus of a display panel according to some embodiments of the present disclosure.

As shown in FIG. 3, the embodiment of the present disclosure also discloses a driving apparatus 3 of a display panel, which is used to implement the driving method of the display panel disclosed in any of the above-mentioned embodiments. The driving apparatus 3 of the display panel includes a picture detection unit 31, a timing controller 32, a target cathode voltage determination unit 33 and a power supply driving chip 34.

The picture detection unit 31 is configured to generate a refresh rate adjustment instruction in response to detecting that the display panel is switched from a dynamic picture to a static picture and send the refresh rate adjustment instruction to the timing controller 32.

The timing controller 32 is configured to, according to the refresh rate adjustment instruction, switch the picture refresh rate of the display panel from a first picture refresh rate to a second picture refresh rate and generate a voltage adjustment instruction, and send the voltage adjustment instruction to the power supply driving chip.

The target cathode voltage determining unit 33 is configured to obtain a target cathode power supply voltage matching the second picture refresh rate.

The power supply driving chip 34 is configured to adjust the display panel to change a working current of each pixel in the display panel, based on the voltage adjustment instruction and the target cathode power supply voltage.

The driving apparatus 3 of the display panel may further include a database setting unit 35, which is configured to preset a mapping database regarding a mapping relationship between the cathode power supply voltage and the picture refresh rate of the display panel.

In another embodiment, the picture detection unit 31 may further include a graphics processor. The graphics processor is used to judge whether a seamless dynamic refresh rate switching technology is switched from an off state to an on state; and in response to judging that the seamless dynamic refresh rate switching technology is switched from the off state to the on state, determine that the display panel is switched from the dynamic picture to the static picture and generate the refresh rate adjustment instruction. If the switching state of the seamless dynamic refresh rate switching technology is not changed, then the current picture refresh rate will remain unchanged.

In the above mapping database, one cathode power supply voltage value corresponds to one picture refresh rate. The above-mentioned cathode power supply voltage increases as the picture refresh rate decreases, and decreases as the picture refresh rate increases.

The picture detection unit 31 receives the picture signal (for example, Electronic Data Processing (EDP) signal, etc.) provided by the computer side through the relevant picture analysis integrated circuit(IC), analyzes the frame rate of the picture (that is, the frame rate can be calculated in information flow of the transmitted picture signal), and then searches the mapping database of the ELVSS voltage to obtain the corresponding instruction. After obtain the corresponding instruction, the picture detection unit 31 send the instruction to the integrated circuit supplying the ELVSS voltage. The ELVSS terminal is connected to the cathode of the display panel, and the cathode physically corresponds to the negative electrode of the light-emitting diode of the pixel circuit.

The picture detection unit 31, target cathode voltage determining unit 33 and the database setting unit 35 in the present disclosure can be implemented by the circuit or the integrated circuit, or implemented by the microprocessor, or implemented in other ways that are known in the art.

It can be understood that the driving apparatus of the display panel of the present disclosure also includes other existing functional modules that support the operation of the driving apparatus of the display panel. The driving apparatus of the display panel shown in FIG. 3 is only an example, and should not bring any limitation to the function and application scope of the embodiment of the present disclosure.

The driving apparatus of the display panel in this embodiment is used to implement the above-mentioned driving method of the display panel. Therefore, for the specific implementation steps of the driving device of the display panel, refer to the detailed description of the above-mentioned driving method of the display panel, which will not repeat herein.

In summary, the driving method and driving apparatus of the display panel of the present disclosure have at least the following advantages.

The driving method and driving apparatus of the display panel disclosed in this embodiment detect whether the display panel is switched from a dynamic picture to a static picture, thereby controlling the switching of the picture refresh rate, and when the picture refresh rate decreases, a corresponding cathode power supply voltage adjustment is performed, in order to reduce the working current of each pixel, thus reducing the brightness of the display panel, and realizing the brightness compensation when the refresh rate is switched. The present application realizes that when the picture refresh rate of the display panel is reduced, the brightness difference before and after the brightness rises is reduced, and the occurrence of the screen flicker phenomenon is avoided.

Compared with the prior art, the present disclosure has the following beneficial effects.

The driving method and driving apparatus of the display panel provided by the present disclosure may detect whether the display panel is switched from a dynamic picture to a static picture, thereby controlling the switching of the picture refresh rate, and when the picture refresh rate decreases, a working current of each pixel is reduced by correspondingly adjusting the cathode power supply voltage, thereby reducing the brightness of the display panel, and realizing a brightness compensation when the picture refresh rate is switched. The present disclosure realizes that when the picture refresh rate of the display panel is reduced, the brightness difference before and after the brightness rises is reduced, and the occurrence of the screen flicker phenomenon is avoided.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

The terms "module," "sub-module," "circuit," "sub-circuit," "circuitry," "sub-circuitry," "unit," or "sub-unit" may include memory (shared, dedicated, or group) that stores code or instructions that can be executed by one or more processors. A module may include one or more circuits with or without stored code or instructions. The module or circuit may include one or more components that are directly or indirectly connected. These components may or may not be physically attached to, or located adjacent to, one another.

A unit or module may be implemented purely by software, purely by hardware, or by a combination of hardware and software. In a pure software implementation, for example, the unit or module may include functionally related code blocks or software components, that are directly or indirectly linked together, so as to perform a particular function.

In the description of this specification, descriptions with reference to the terms 'one embodiment', 'some embodiments', 'exemplary embodiments', 'examples', 'specific examples' and the like refer to specific features, structures, materials, or characteristics of descriptions in conjunction with the embodiments or examples, which are included in at least one embodiment or example of the present disclosure. In this specification, the schematic representations of the above-mentioned terms do not necessarily refer to the same embodiment or example. Moreover, the described specific features, structures, materials or characteristics can be combined in any one or more embodiments or examples in an appropriate manner.

The above content is a further detailed description of the present disclosure in conjunction with specific preferred embodiments, and it cannot be considered that the specific implementation of the present disclosure is limited to these descriptions. For those of ordinary skill in the technical field to which the present disclosure belongs, a number of simple deductions or substitutions can be made without departing from the concept of the present disclosure, and these should be regarded as belonging to the protection scope of the present disclosure.

What is claimed is:

1. A driving method of a display panel, comprising:

presetting a mapping database regarding a mapping relationship between a plurality of cathode power supply voltages and at least a first picture refresh rate, a second picture refresh rate, a third picture refresh rate, and a fourth picture refresh rate of the display panel;

in response to detecting that the display panel is switched from a dynamic picture to a static picture, generating a refresh rate adjustment instruction;

according to the refresh rate adjustment instruction, switching the picture refresh rate of the display panel from the first picture refresh rate to the second picture refresh rate and generating a voltage adjustment instruction;

obtaining a target cathode power supply voltage matching the second picture refresh rate based on the mapping database; and based on the voltage adjustment instruction and the target cathode power supply voltage, adjusting the display panel to change a working current of each pixel in the display panel;

wherein the voltage adjustment instruction is used to increase the cathode power supply voltage of the display panel according to the refresh rate adjustment instruction, and wherein the cathode power supply voltage increases as the picture refresh rate decreases, and the cathode power supply voltage decreases as the picture refresh rate increase, so as to reduce the working current of each pixel in the display panel.

2. The method according to claim 1, wherein generating the refresh rate adjustment instruction in response to detecting that the display panel is switched from the dynamic picture to the static picture comprises: judging whether a seamless dynamic refresh rate switching technology is switched from an off state to an on state; and in response to judging that the seamless dynamic refresh rate switching technology is switched from the off state to the on state, determining that the display panel is switched from the dynamic picture to the static picture, and generating the refresh rate adjustment instruction.

3. The method according to claim 1, wherein the first picture refresh rate is greater than the second picture refresh rate, and the target cathode power supply voltage that matches the second picture refresh rate is greater than the cathode power supply voltage that matches the first picture refresh rate.

4. A driving apparatus of a display panel, comprising:

a database setting unit configured to preset a mapping database regarding a mapping relationship between a plurality of cathode power supply voltages and at least a first picture refresh rate, a second picture refresh rate, a third picture refresh rate, and a fourth picture refresh rate of the display panel, a picture detection unit configured to generate a refresh rate adjustment instruction in response to detecting that the display panel is switched from a dynamic picture to a static picture and send the refresh rate adjustment instruction to the timing controller;

a timing controller configured to, according to the refresh rate adjustment instruction, switch the picture refresh rate of the display panel from the first picture refresh rate to the second picture refresh rate and generate a voltage adjustment instruction, and send the voltage adjustment instruction to the power supply driving chip;

a target cathode voltage determination unit configured to obtain a target cathode power supply voltage matching the second picture refresh rate, based on the mapping database, and send the target cathode power supply voltage to the power supply driving chip; and a power supply driving chip configured to adjust the display panel to change a working current of each pixel in the display panel, based on the voltage adjustment instruction and the target cathode power supply voltage;

wherein the voltage adjustment instruction is used to increase the cathode power supply voltage of the display panel according to the refresh rate adjustment instruction, and wherein the cathode power supply voltage increases as the picture refresh rate decreases, and the cathode power supply voltage decreases as the picture refresh rate increase, so as to reduce the working current of each pixel in the display panel.

5. The apparatus according to claim 4, wherein the picture detection unit further comprises a graphics processor, and the graphics processor is configured to: judge whether a seamless dynamic refresh rate switching technology is switched from an off state to an on state; and in response to judging that the seamless dynamic refresh rate switching technology is switched from the off state to the on state, determine that the display panel is switched from the dynamic picture to the static picture, and generate the refresh rate adjustment instruction.

6. The apparatus according to claim 4, wherein the first picture refresh rate is greater than the second picture refresh rate, and the target cathode power supply voltage that matches the second picture refresh rate is greater than the cathode power supply voltage that matches the first picture refresh rate.

7. A driving method of a display panel, comprising:

presetting a mapping database regarding a mapping relationship between a plurality of cathode power supply voltages and at least a first picture refresh rate, a second picture refresh rate, a third picture refresh rate, and a fourth picture refresh rate of the display panel;

in response to detecting that the display panel is switched from a static picture to a dynamic picture, generating a refresh rate adjustment instruction;

according to the refresh rate adjustment instruction, switching the picture refresh rate of the display panel from the third picture refresh rate to the fourth picture refresh rate and generating a voltage adjustment instruction;

obtaining a target cathode power supply voltage matching the fourth picture refresh rate based on the mapping database; and based on the voltage adjustment instruction and the target cathode power supply voltage, adjusting the display panel to change a working current of each pixel in the display panel;

wherein the voltage adjustment instruction is used to decrease the cathode power supply voltage of the display panel according to the refresh rate adjustment instruction, and wherein the cathode power supply voltage increases as the picture refresh rate decreases, and the cathode power supply voltage decreases as the picture refresh rate increase, so as to reduce the working current of each pixel in the display panel.

8. The method according to claim 7, wherein generating the refresh rate adjustment instruction in response to detecting that the display panel is switched from the static picture to the dynamic picture comprises: judging whether a seamless dynamic refresh rate switching technology is switched from an on state to an off state; and in response to judging that the seamless dynamic refresh rate switching technology is switched from the on state to the off state, determining that the display panel is switched from the static picture to the dynamic picture, and generating the refresh rate adjustment instruction.

* * * * *